US011226110B2

(12) United States Patent
DeMonte et al.

(10) Patent No.: US 11,226,110 B2
(45) Date of Patent: Jan. 18, 2022

(54) IN-WALL DEHUMIDIFIER

(71) Applicant: Therma-Stor LLC, Madison, WI (US)

(72) Inventors: Todd R. DeMonte, Cottage Grove, WI (US); Steven S. Dingle, McFarland, WI (US); Richard G. Giallombardo, Cottage Grove, WI (US); Joshua William Henry, Columbus, WI (US); Jared M. Stearns, Madison, WI (US); Jerome Verhoeven, Sun Prairie, WI (US)

(73) Assignee: THERMA-STOR LLC, Madison, WI (US)

( * ) Notice: Subject to any disclaimer, the term of this patent is extended or adjusted under 35 U.S.C. 154(b) by 320 days.

(21) Appl. No.: 15/881,892

(22) Filed: Jan. 29, 2018

(65) Prior Publication Data

US 2019/0234623 A1 Aug. 1, 2019

(51) Int. Cl.

| | |
|---|---|
| ***F24F 1/0011*** | (2019.01) |
| ***F24F 13/24*** | (2006.01) |
| ***F24F 13/30*** | (2006.01) |
| ***F24F 13/22*** | (2006.01) |
| ***F24F 1/0057*** | (2019.01) |

(52) U.S. Cl.

CPC ..... *F24F 1/0011* (2013.01); *F24F 13/222* (2013.01); *F24F 13/24* (2013.01); *F24F 13/30* (2013.01); *F24F 1/0057* (2019.02); *F24F 2221/17* (2013.01)

(58) Field of Classification Search

CPC .. F24F 1/02; F24F 1/031; F24F 1/0011; F24F 1/0057; F24F 1/0007; F24F 13/222; F24F 13/24; F24F 13/30; F24F 13/32; F24F 2221/17

See application file for complete search history.

(56) References Cited

U.S. PATENT DOCUMENTS 3,308,634 A * 3/1967 Smith ..... F24F 13/20 62/263
3,811,369 A * 5/1974 Ruegg ..... F24F 13/072 454/304
4,129,013 A * 12/1978 Hine, Jr. ..... F24F 13/22 165/136

(Continued)

OTHER PUBLICATIONS

Accord ABBBWH15 Baseboard Register with Sunburst Design. 2009. Accessed via web <https://www.amazon.com/Accord-ABBBWH15-Baseboard-Register-Measurement/dp/B002OUCATS?th=1> Jan. 30, 2021.*

(Continued)

*Primary Examiner* — Tavia Sullens
(74) *Attorney, Agent, or Firm* — Baker Botts L.L.P.

(57) ABSTRACT

A dehumidifier includes a cabinet, a compressor, an evaporator, a condenser, and a fan. The cabinet is configured to be installed between studs in a wall. The evaporator is installed within the cabinet above the compressor. The condenser is installed within the cabinet above the evaporator. The fan is installed between the evaporator and a back surface of the cabinet. The fan is configured to generate the airflow that flows into the cabinet through the evaporator and out of the cabinet through condenser. The airflow flows through the evaporator and condenser in order to provide dehumidification to the airflow.

20 Claims, 16 Drawing Sheets

(56) References Cited

U.S. PATENT DOCUMENTS

| | | | | |
|---|---|---|---|---|
| 4,958,500 | A * | 9/1990 | Kuroda | F24F 1/02 62/263 |
| 2005/0161202 | A1* | 7/2005 | Merkys | F25B 39/04 165/122 |
| 2006/0213157 | A1* | 9/2006 | Kalous | F24F 3/1603 55/385.2 |
| 2012/0291463 | A1 | 11/2012 | O'Brien | |
| 2015/0159890 | A1* | 6/2015 | Chang | F24F 3/1405 62/515 |
| 2016/0123651 | A1* | 5/2016 | Barbely | F24F 13/222 62/291 |
| 2017/0321907 | A1 | 11/2017 | Crawford | |
| 2018/0038602 | A1* | 2/2018 | Janesky | F24F 13/222 |

OTHER PUBLICATIONS

Innovative Dehumidifiers "The IW25 In-Wall Dehumidifier is Equipped with a Built-in Auto Dehumidistat," https://www.innovativedehumidifiers.com/, Downloaded Jan. 29, 2018.

"InnovativeDehumidifier." SpecData. Copyright 2015.https://www.innovativedehumidifiers.com/wp-content/uploads/2015/03/Innovative-Dehumidifier-238416_SD_IW25-Inwall_2015-2.pdf.

"Innovative Dehumidifier Systems IW25-2 model." Posted on Nov. 28, 2015 by davidc@ccr-mag.com. http://www.ccr-mag.com/innovative-dehumidifier-systems-iw25-2-model/.

Adam. "IW25-1 In-Wall Dehumidifiers." Posted on Aug. 4, 2014. http://blog.supplyhouse.com/iw25-1-in-wall-dehumidifiers/.

* cited by examiner

IN-WALL DEHUMIDIFIER

TECHNICAL FIELD

This invention relates generally to dehumidification and more particularly to an in-wall dehumidifier.

BACKGROUND OF THE INVENTION

In certain situations, it is desirable to reduce the humidity of air within a structure. For example, homes and apartments may need dehumidification during certain times of the year to reduce the moisture levels within the living spaces. To accomplish this, one or more dehumidifiers may be placed within the structure to dehumidify the air. Current dehumidifiers, however, are typically bulky and require valuable floor space.

SUMMARY OF THE INVENTION

According to embodiments of the present disclosure, disadvantages and problems associated with previous dehumidification systems may be reduced or eliminated.

In some embodiments, a dehumidifier includes a cabinet configured to be installed between studs in a wall and an air diffuser configured to diffuse an airflow from the dehumidifier along a surface of the wall. The air diffuser includes an inlet, an outlet above the inlet, and a divider between the inlet and outlet. The divider is configured to prevent the airflow entering the cabinet through the inlet from mixing with the airflow exiting the cabinet from the outlet. The dehumidifier further includes a compressor, an evaporator installed within the cabinet above the compressor, and a condenser installed within the cabinet above the evaporator. The condenser includes a plurality of microchannel condenser coils. The dehumidifier further includes a fan installed between the evaporator and a back surface of the cabinet. The fan is configured to generate the airflow that flows into the cabinet through the inlet of the air diffuser and out of the cabinet through the outlet of the air diffuser. The airflow flows through the evaporator and condenser in order to provide dehumidification to the airflow. The dehumidifier further includes a drain pan installed within the cabinet below the evaporator. The drain pan is configured to capture water removed from the airflow by the evaporator. The drain pan includes a notch and a tab configured to direct an overflow from the drain pan to a front face of the cabinet, thereby causing the overflow to be visible when the dehumidifier is installed in the wall. The dehumidifier further includes a sensor installed below the drain pan. The sensor is configured to sense one or more environmental conditions of a bypass portion of the airflow.

In some embodiments, a dehumidifier includes a cabinet configured to be installed between studs in a wall, an air diffuser configured to diffuse an airflow from the dehumidifier along a surface of the wall, a compressor, an evaporator installed within the cabinet above the compressor, a condenser installed within the cabinet above the evaporator, and a fan. The fan is installed between the evaporator and a back surface of the cabinet. The fan is configured to generate the airflow that flows into the cabinet through an inlet of the air diffuser and out of the cabinet through an outlet of the air diffuser. The airflow flows through the evaporator and condenser in order to provide dehumidification to the airflow.

In certain embodiments, a dehumidifier includes a cabinet configured to be installed between studs in a wall, a compressor, an evaporator installed within the cabinet above the compressor, a condenser installed within the cabinet above the evaporator, and a fan installed between the evaporator and a back surface of the cabinet. The fan is configured to generate the airflow that flows into the cabinet through the evaporator and out of the cabinet through condenser. The airflow flows through the evaporator and condenser in order to provide dehumidification to the airflow.

Certain embodiments of the present disclosure may provide one or more technical advantages. For example, certain embodiments provide an in-wall dehumidifier that may be installed within existing spaces between wall studs. This reduces or eliminates the amount of living space required for the dehumidifier. Some embodiments may be blindly installed (i.e., installed while only requiring access from one side of a wall) within typically-spaced 2×4 or 2×6 wall studs. This reduces the installation time, cost, and complexity over existing systems. Some embodiments include innovative air diffusers and arrangements of internal components to provide indirect airflow into living spaces, thereby reducing undesirable drafts caused by typical dehumidifiers.

Certain embodiments of the present disclosure may include some, all, or none of the above advantages. One or more other technical advantages may be readily apparent to those skilled in the art from the figures, descriptions, and claims included herein.

BRIEF DESCRIPTION OF THE DRAWINGS

To provide a more complete understanding of the present invention and the features and advantages thereof, reference is made to the following description taken in conjunction with the accompanying drawings, in which.

DETAILED DESCRIPTION OF THE DRAWINGS

In certain situations, it is desirable to reduce the humidity of air within a structure. For example, homes and apartments may need dehumidification during certain times of the year to reduce the moisture levels within the living spaces. To accomplish this, one or more dehumidifiers may be placed within the structure to dehumidify the air. Current dehumidifiers, however, are typically bulky and require valuable floor space.

Figure 1:
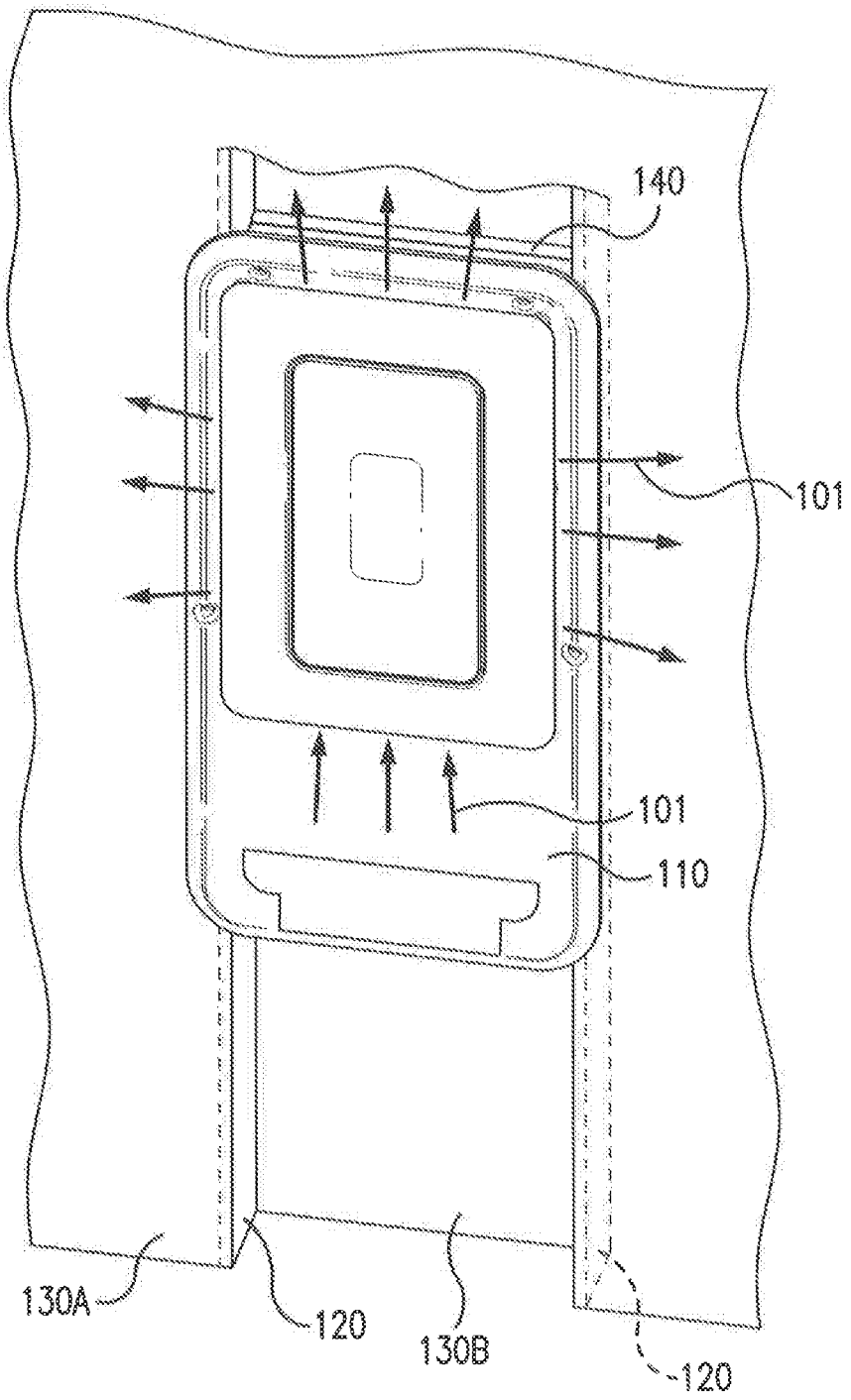
FIG. 1 illustrates an in-wall dehumidifier installed between typical wall studs, according to certain embodiments.
Figure 2A:
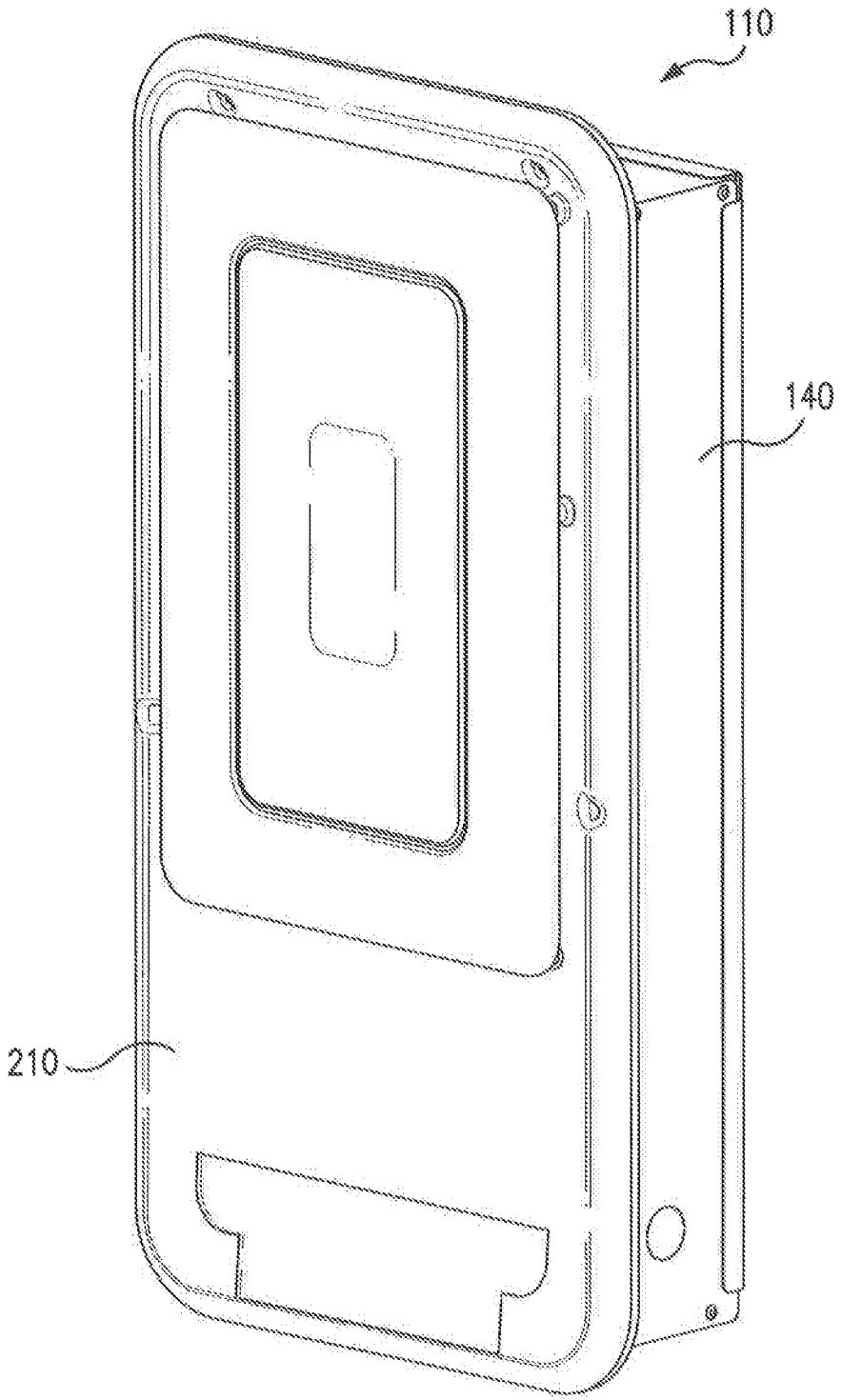
FIGS. 2A-2B illustrate perspective views of the in-wall dehumidifier of FIG. 1, according to certain embodiments.
Figure 2B:
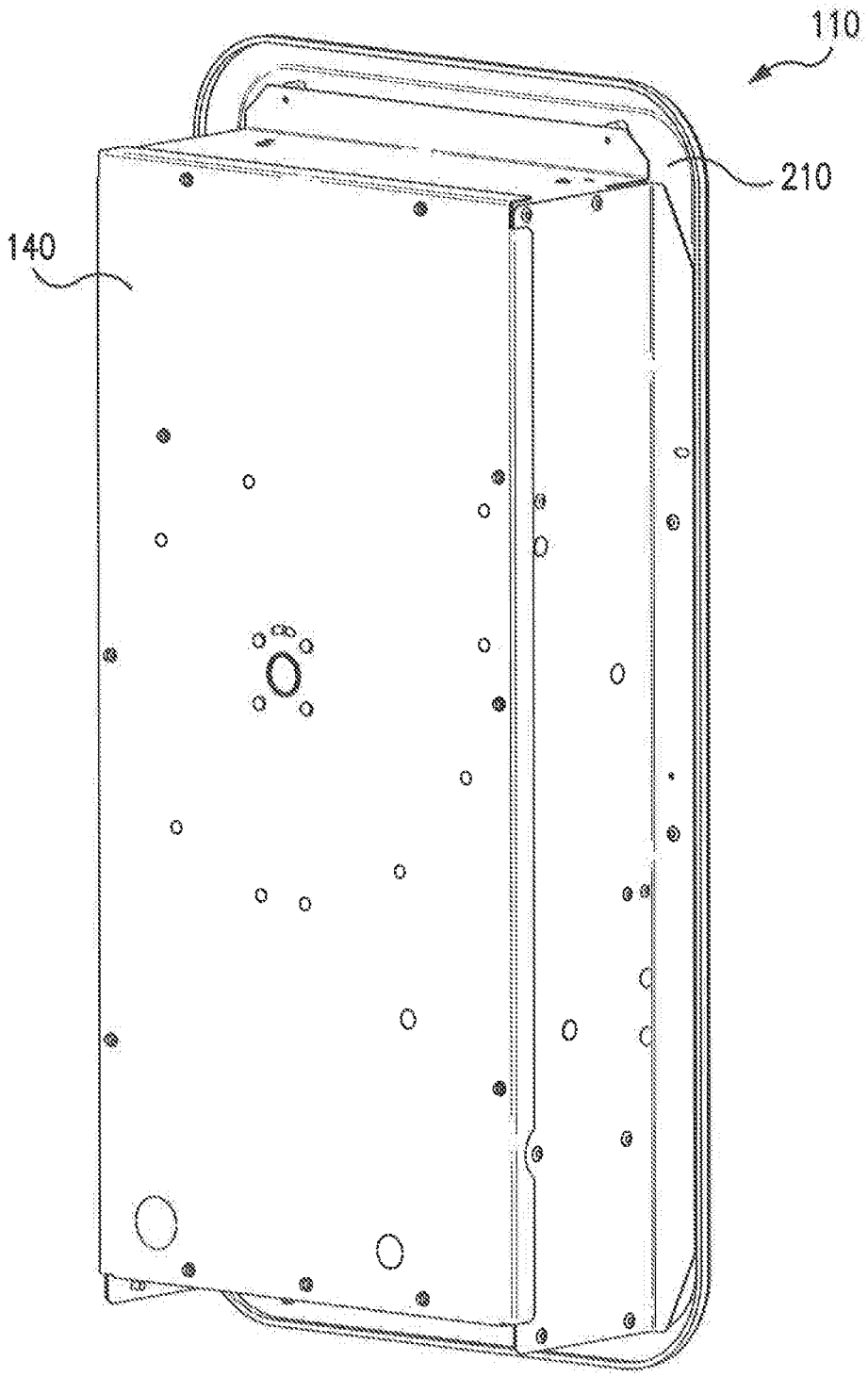
Figure 3:
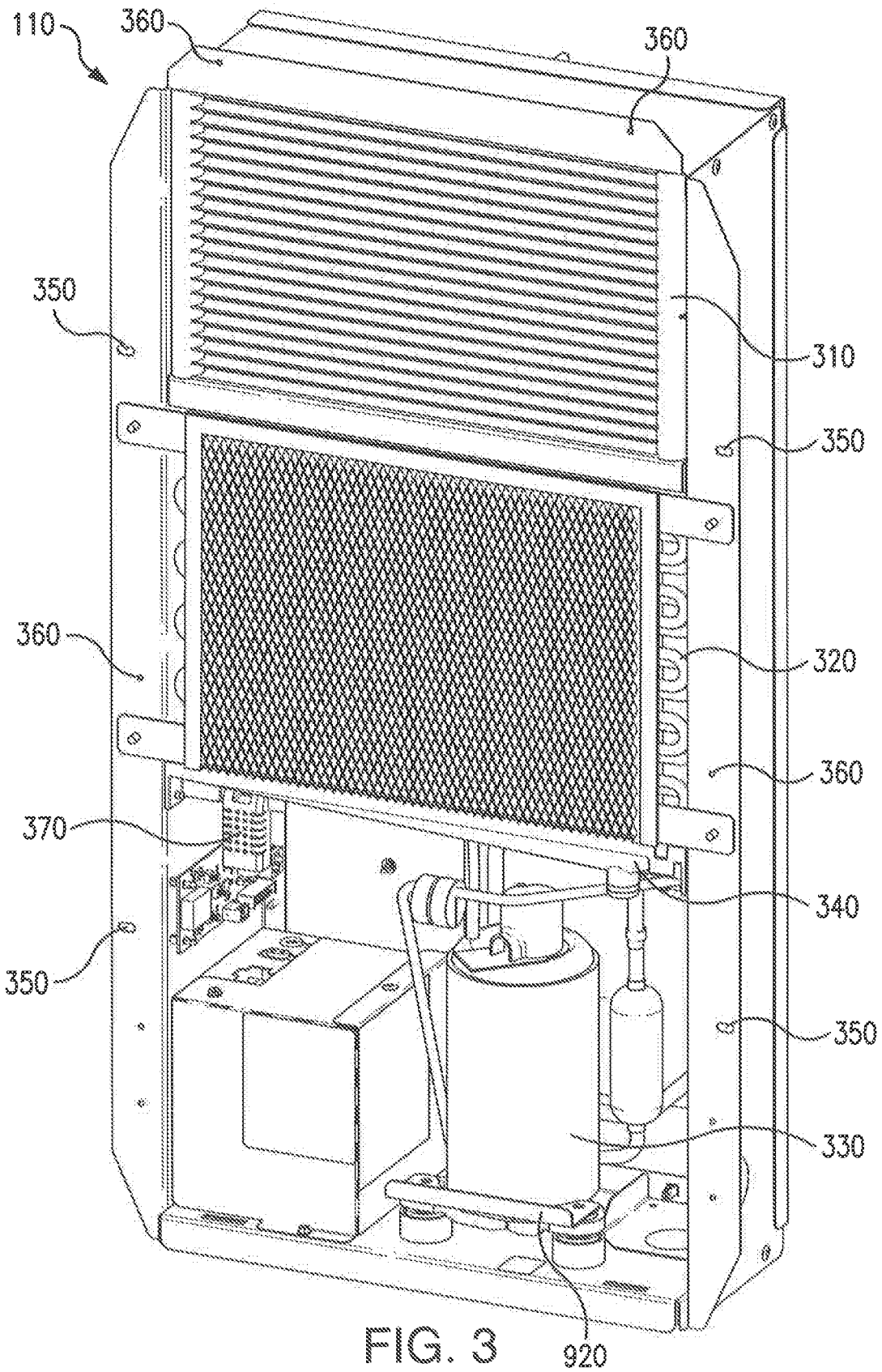
FIG. 3 illustrates an arrangement of internal components of the in-wall dehumidifier of FIG. 1, according to certain embodiments.
Figure 4:
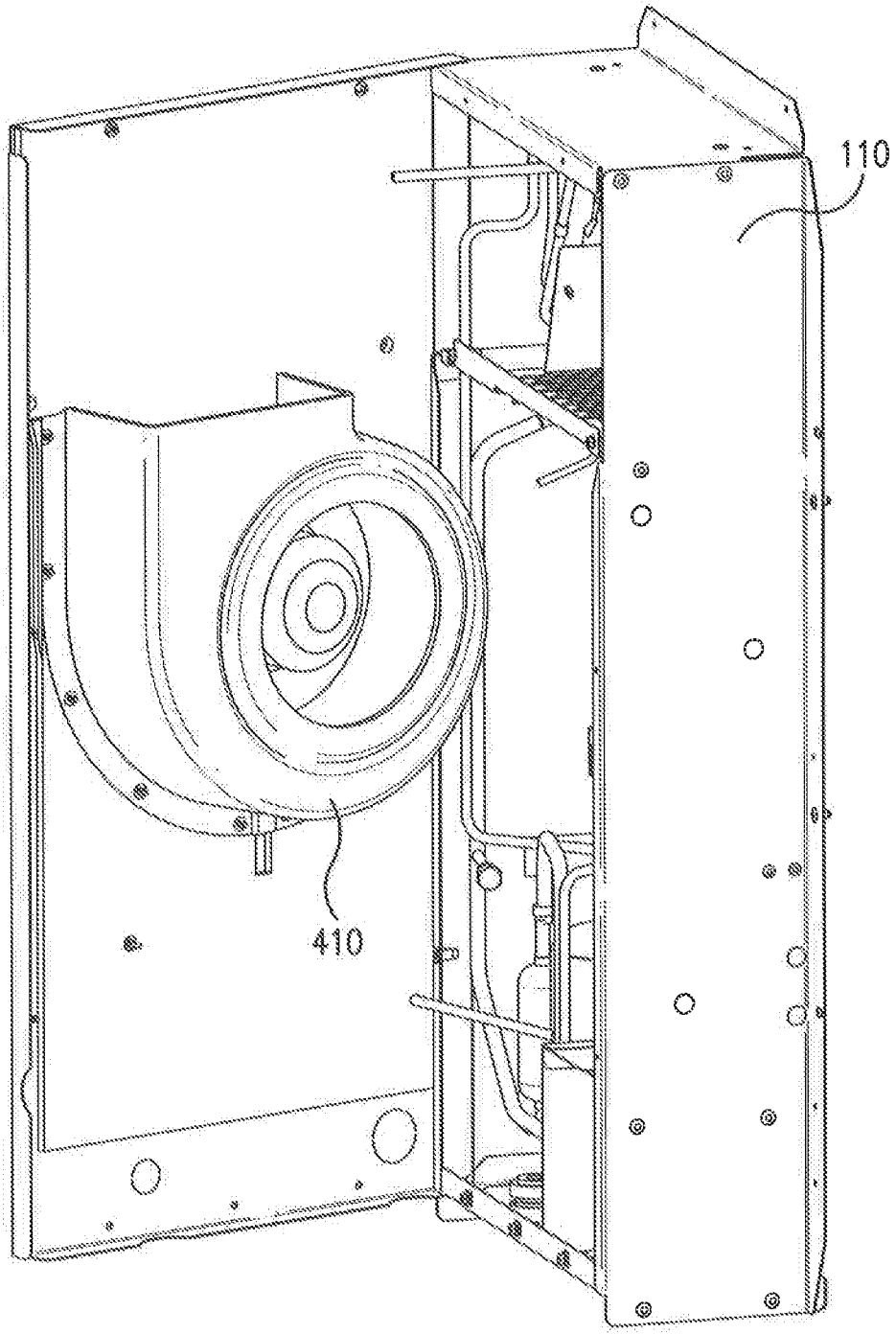
FIG. 4 illustrates the in-wall dehumidifier of FIG. 1 with its rear panel opened, according to certain embodiments.
Figure 5A:
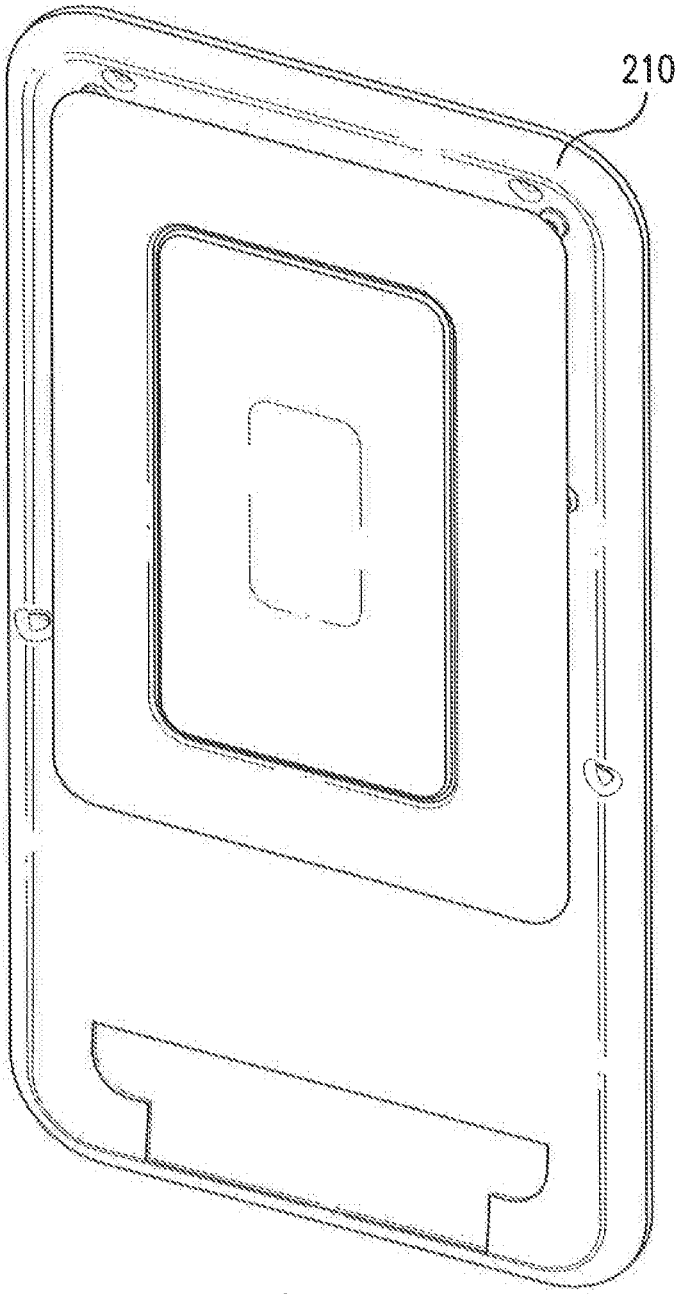
FIGS. 5A-5B illustrate perspective views of the air diffuser of the in-wall dehumidifier of FIG. 1, according to certain embodiments.
Figure 5B:
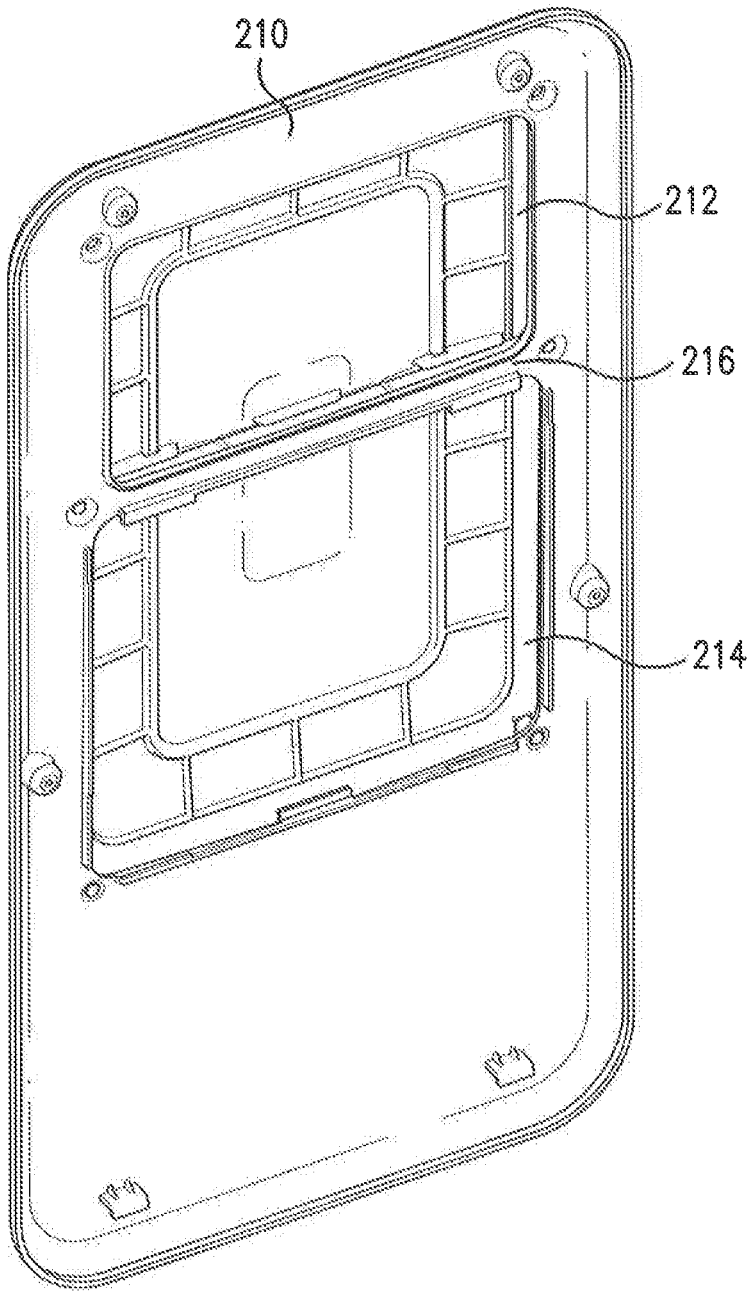
Figure 6A:
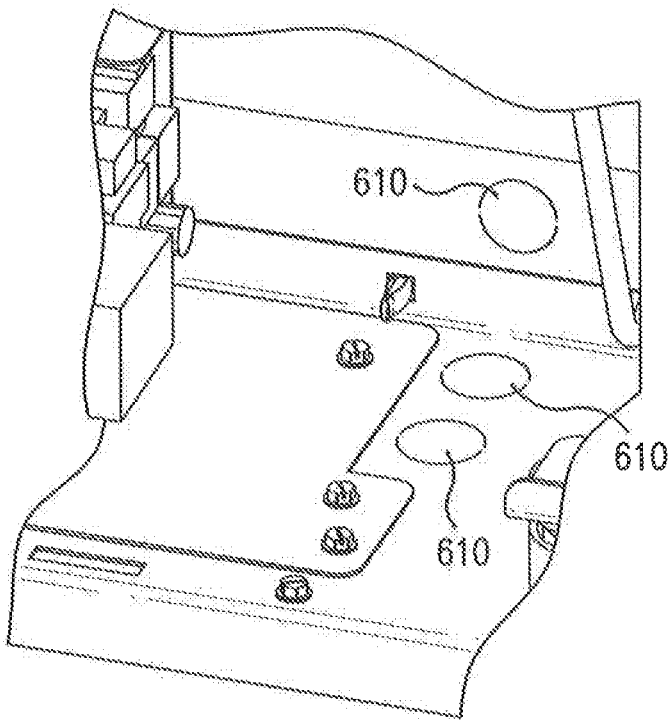
FIGS. 6A-6B illustrate various electrical and plumbing knockouts of the in-wall dehumidifier of FIG. 1, according to certain embodiments.
Figure 6B:
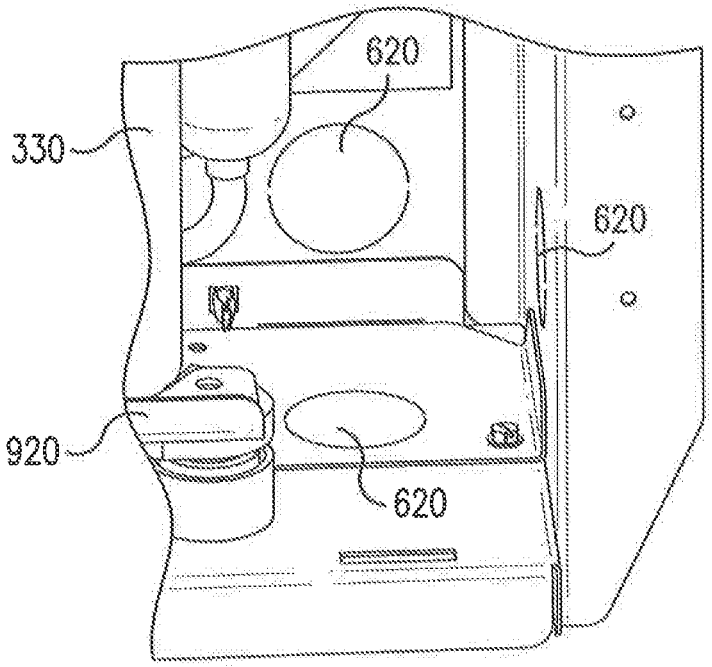
Figure 7A:
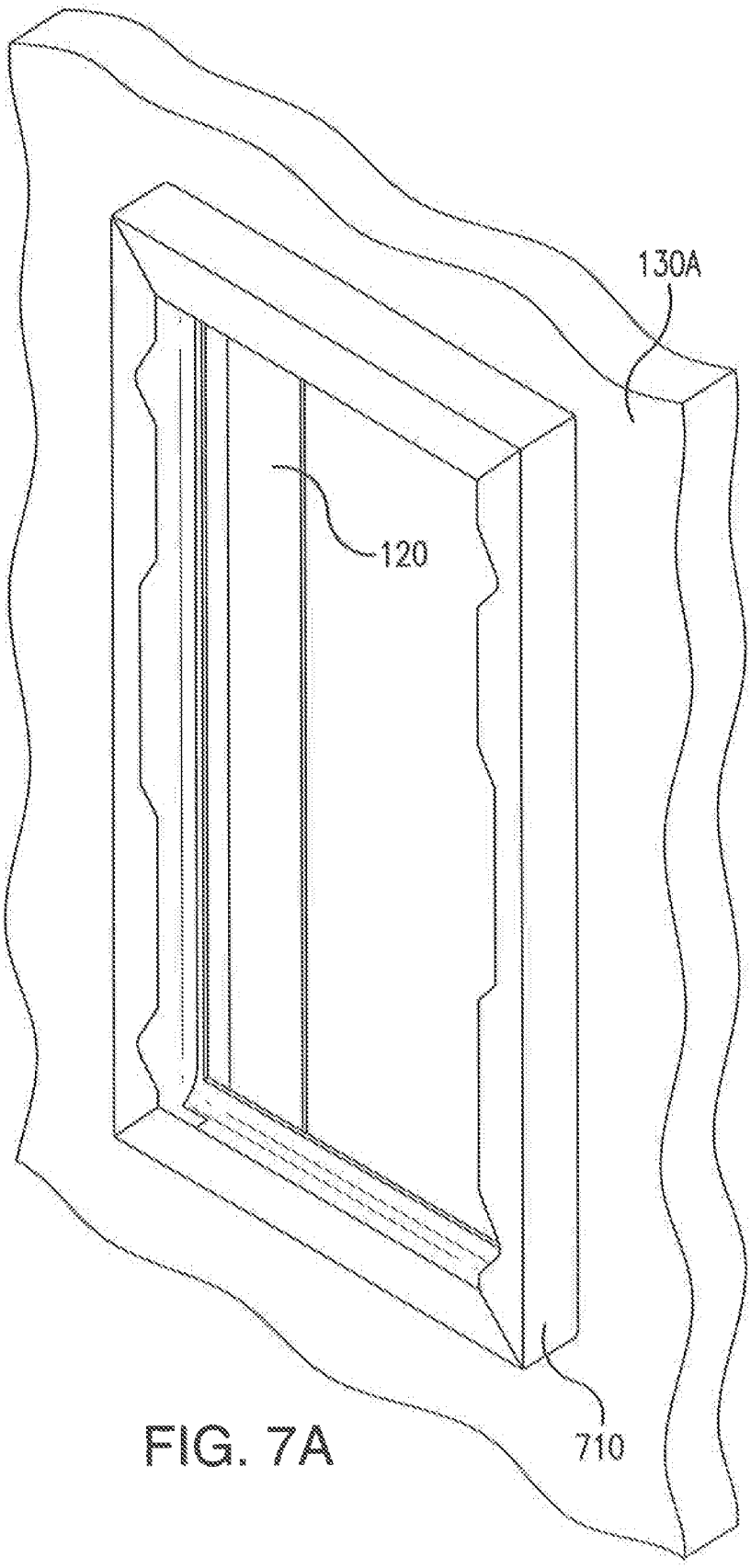
FIGS. 7A-7B illustrate various views of an optional bezel of the in-wall dehumidifier of FIG. 1, according to certain embodiments.
Figure 7B:
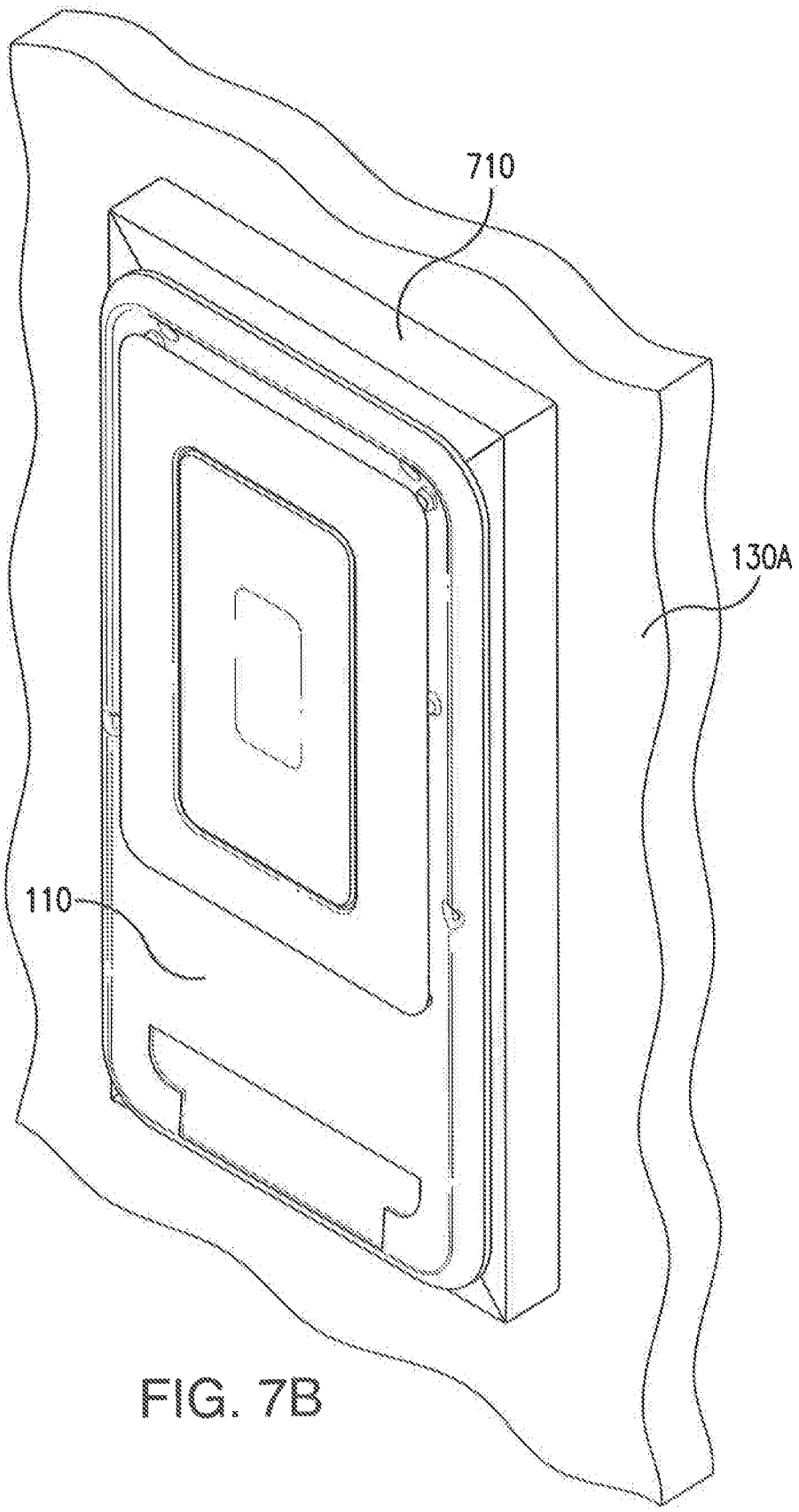
Figure 8A:
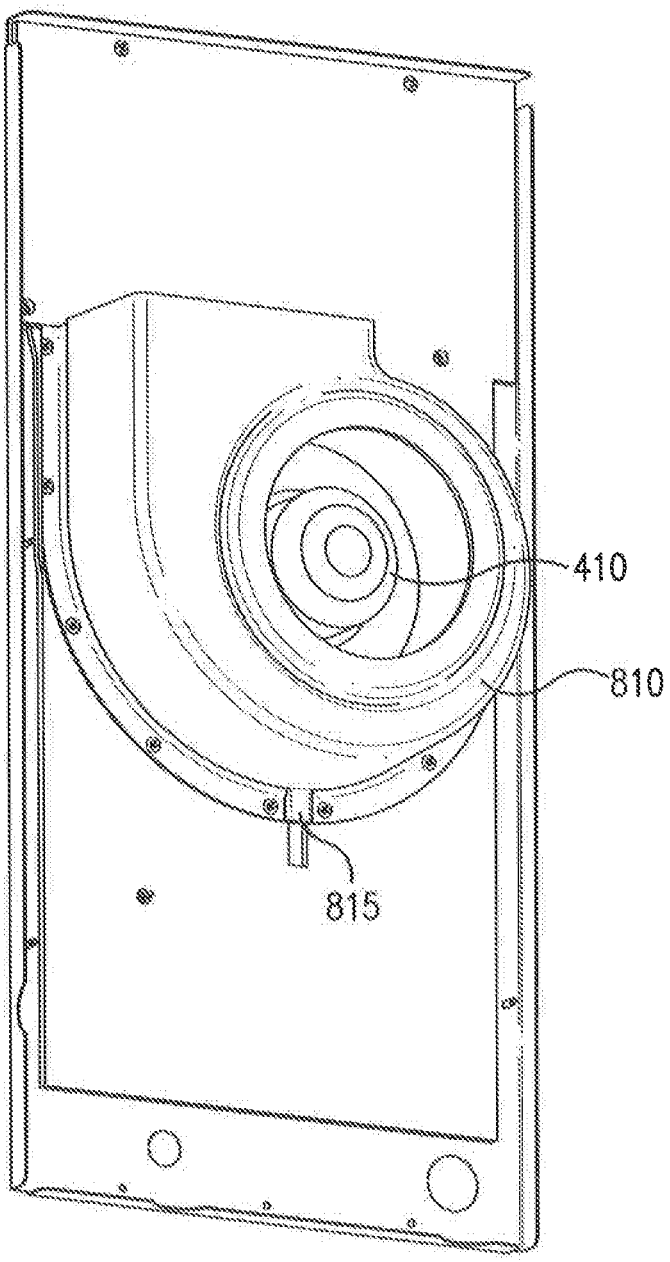
FIGS. 8A-8B illustrate various views of the air blower of the in-wall dehumidifier of FIG. 1, according to certain embodiments.
Figure 8B:
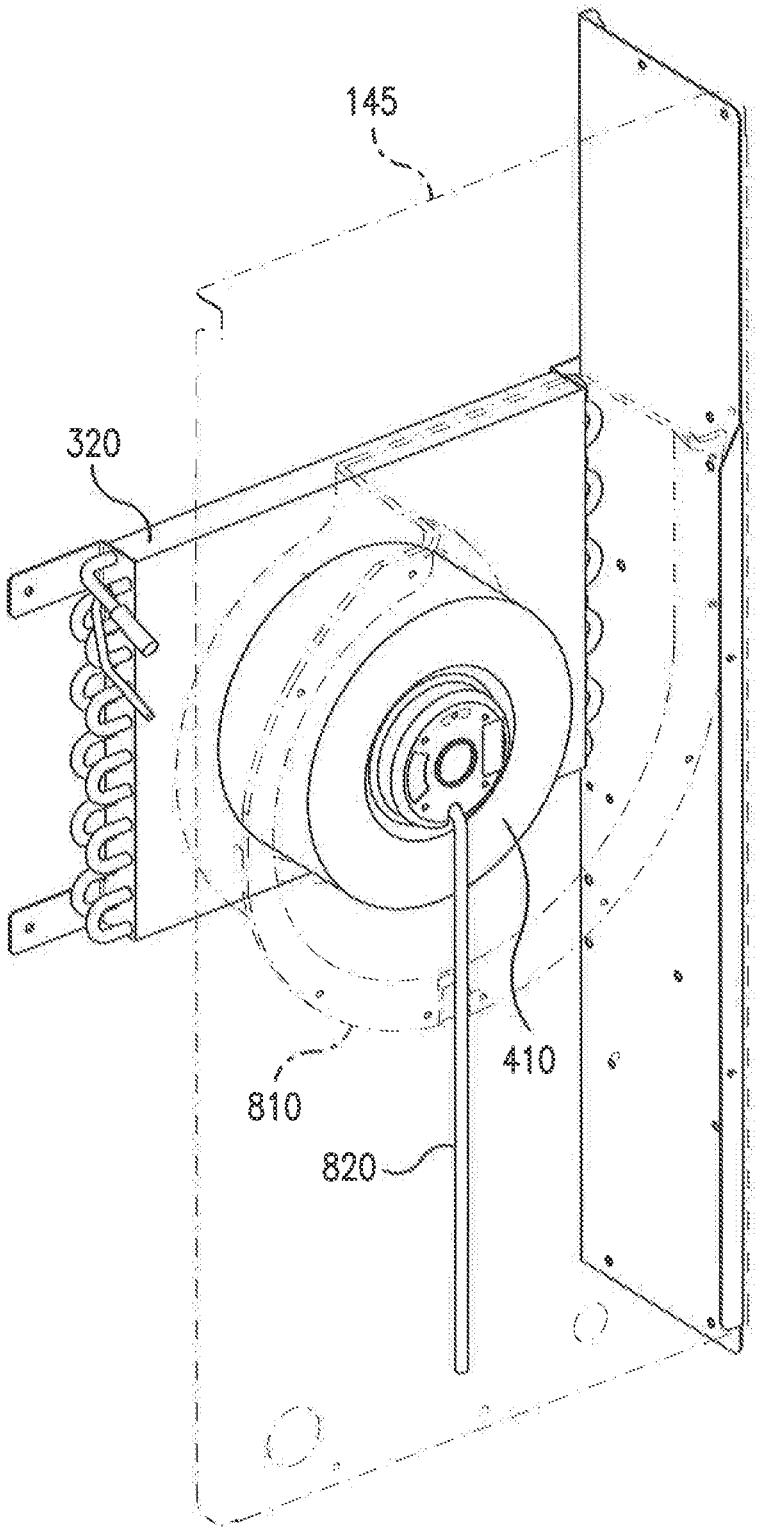
Figure 9:
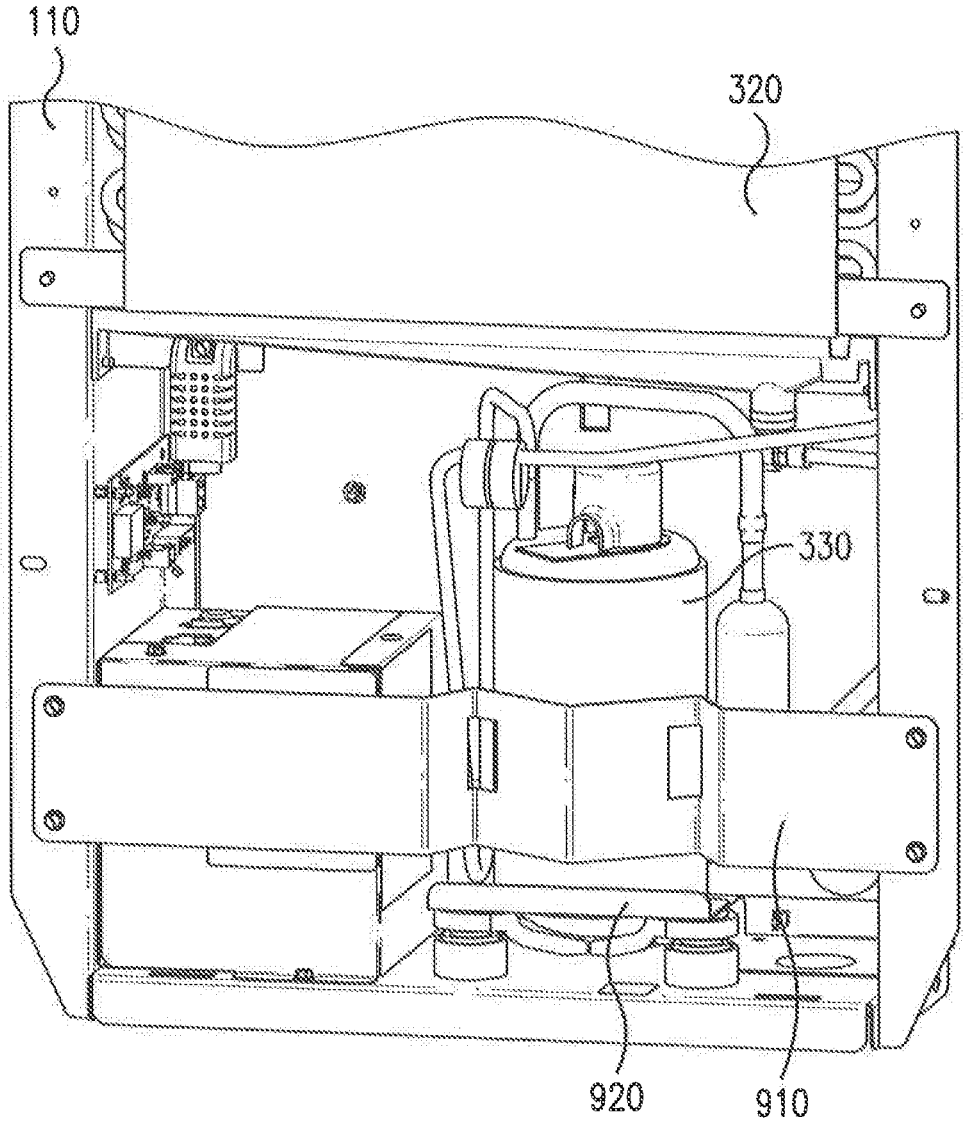
FIG. 9 illustrates various brackets of the in-wall dehumidifier of FIG. 1, according to certain embodiments.
Figure 10:
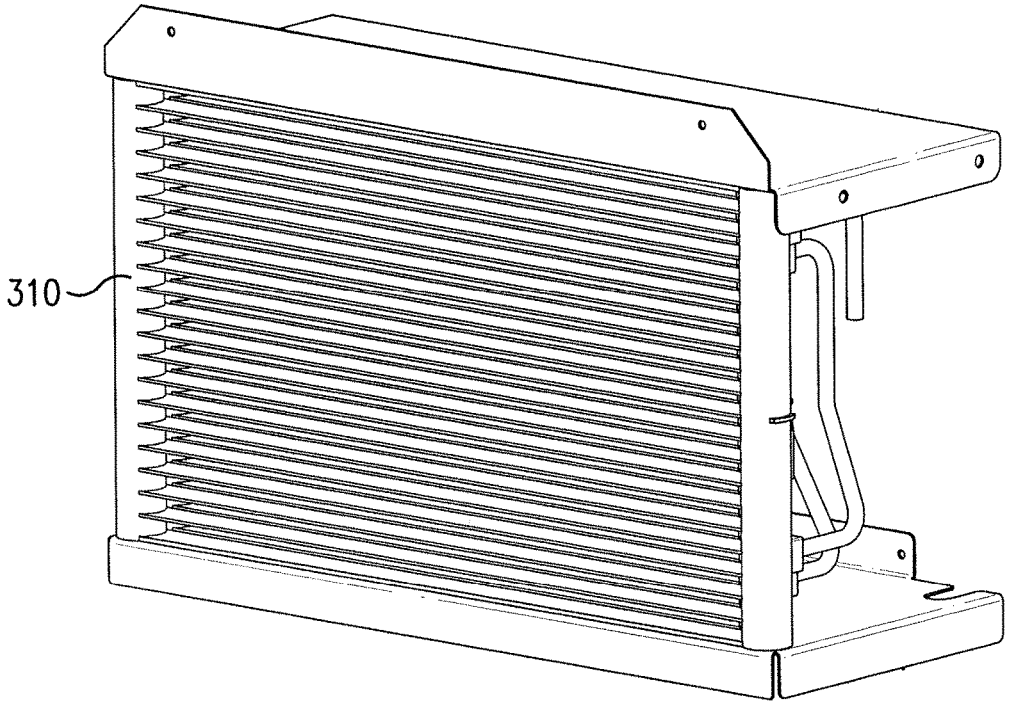
FIG. 10 illustrates condenser brackets of the in-wall dehumidifier of FIG. 1, according to certain embodiments.
Figure 11:
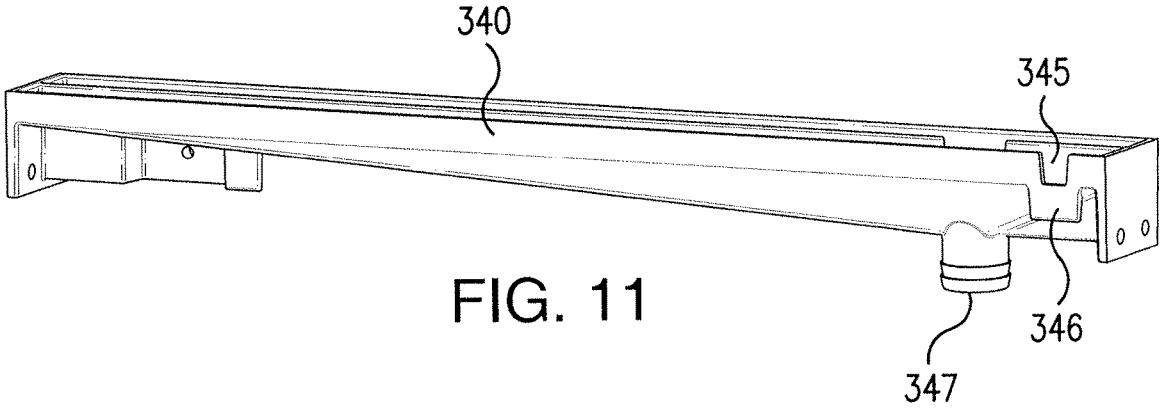
FIG. 11 illustrates a drain pan of the in-wall dehumidifier of FIG. 1, according to certain embodiments.
Figure 12:
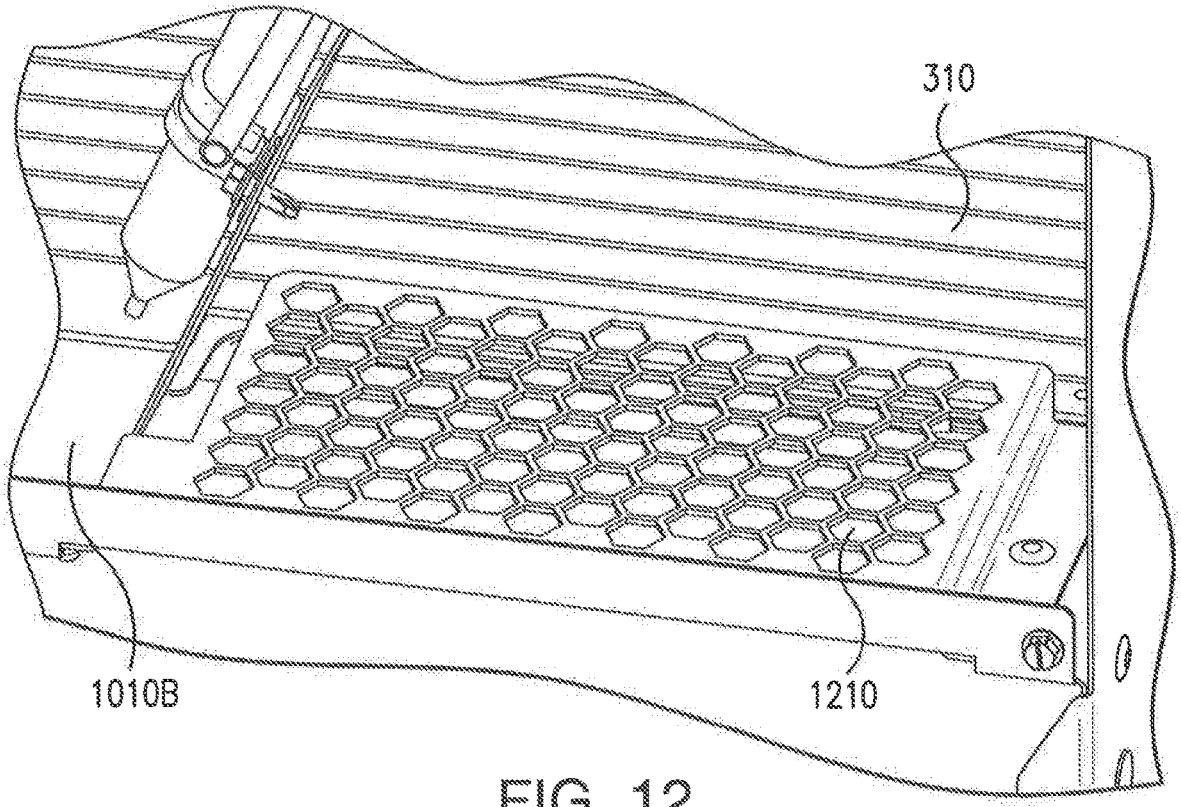
FIG. 12 illustrates a fan outlet diffuser of the in-wall dehumidifier of FIG. 1, according to certain embodiments.
Figure 13:
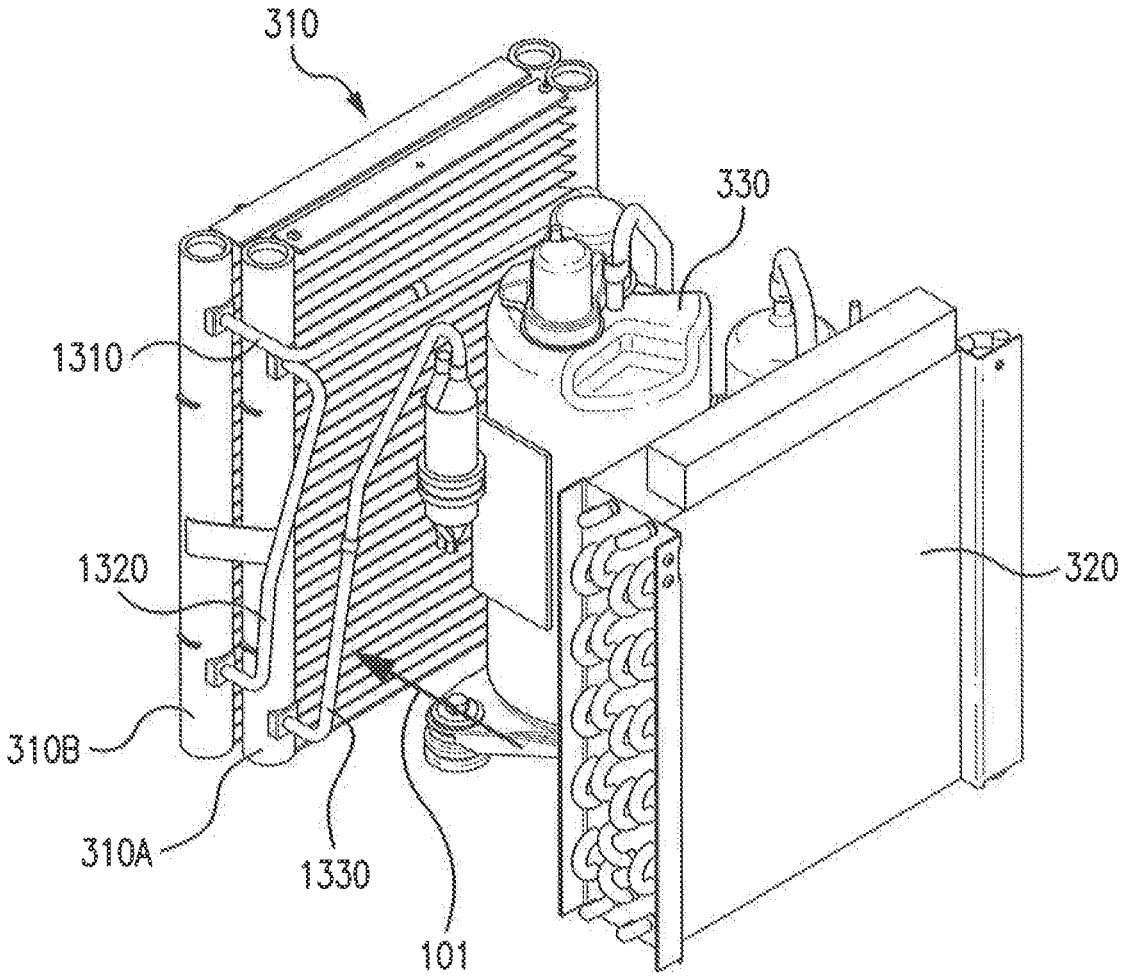
FIG. 13 illustrates a condenser with dual condenser coils that may be used by the in-wall dehumidifier of FIG. 1, according to certain embodiments.

The disclosed embodiments provide an in-wall dehumidifier that includes various features to address the inefficiencies and other issues with current dehumidification systems. The advantages and features of certain embodiments are discussed in more detail below in reference to FIGS. 1-13. FIG. 1 illustrates certain embodiments of an in-wall dehumidifier that may be installed between typical wall studs; FIGS. 2A-2B illustrate perspective views of an in-wall dehumidifier; FIG. 3 illustrates an arrangement of internal components of an in-wall dehumidifier; FIG. 4 illustrates an in-wall dehumidifier with its rear panel opened; FIGS. 5A-5B illustrate perspective views of an air diffuser of an in-wall dehumidifier; FIGS. 6A-6B illustrate various electrical and plumbing knockouts of an in-wall dehumidifier; FIGS. 7A-7B illustrate various views of an optional bezel of an in-wall dehumidifier; FIGS. 8A-8B illustrate various views of an air blower of an in-wall dehumidifier; FIG. 9 illustrates various brackets of an in-wall dehumidifier; FIG. 10 illustrates condenser brackets of an in-wall dehumidifier; FIG. 11 illustrates a drain pan of an in-wall dehumidifier; FIG. 12 illustrates a fan outlet diffuser of an in-wall dehumidifier; and FIG. 13 illustrates a condenser with dual condenser coils that may be used by an in-wall dehumidifier.

FIGS. 1-4 illustrate various views of an in-wall dehumidifier 110, according to certain embodiments. In some embodiments, in-wall dehumidifier 110 includes a cabinet 140, an air diffuser 210, a condenser 310, an evaporator 320, a compressor 330, a drain pan 340, and a sensor 370. While a specific arrangement of these and other components of in-wall dehumidifier 110 are illustrated in these figures, other embodiments may have other arrangements and may have more or fewer components than those illustrated.

In general, in-wall dehumidifier 110 provides dehumidification to an area (e.g., the living areas of a home or apartment) by moving air through in-wall dehumidifier 110. To dehumidify air, in-wall dehumidifier 110 generates an airflow 101 that enters cabinet 140 via air diffuser 210, travels through in-wall dehumidifier 110 where it is dried, and then exits cabinet 140 via air diffuser 210. Water removed from airflow 101 via in-wall dehumidifier 110 may be captured within drain pan 340 and directed to an external drain. A particular embodiment of drain pan 340 is described in more detail below in reference to FIG. 11.

As illustrated in FIG. 1, in-wall dehumidifier 110 may be installed between wall studs 120 of any wall of a structure such as a home or apartment. In-wall dehumidifier 110 may have any appropriate sizes and shapes that permit it to be installed between typical or standard spacing of wall studs 120 (e.g.,16 or 24 inches apart). Unlike existing dehumidification systems, some embodiments of in-wall dehumidifier 110 may be able to be blindly installed within walls (i.e., installed while only requiring access from one side of a wall). For example, some embodiments of in-wall dehumidifier 110 have a limited depth that allows an installer to remove a portion of drywall 130A from only one side of a wall and install in-wall dehumidifier 110 between wall studs 120 without having to remove any drywall 1301 from the other side of the wall. This provides fix an easier installation over existing units, which saves installation time and costs. Furthermore, some embodiments of in-wall dehumidifier 110 include air diffuser 210, which is discussed in more detail below in reference to FIGS. 5A-5B. As illustrated in FIG. 1, air diffuser 210 forces output airflow 101 along the surfaces of the wall in which in-wall dehumidifier 110 is installed parallel to the wall surfaces). This is in contrast to typical systems which send dehumidified air back into the living space perpendicular to the wall, thereby causing undesirable drafts in the living spaces. By utilizing air diffuser 210 to diffuse airflow 101 along the wall surfaces, in-wall dehumidifier 110 reduces or eliminates undesirable drafts in the living spaces.

Cabinet 140 may be any appropriate shape and size. In some embodiments, cabinet 140 has a width that permits in-wall dehumidifier 110 to be installed between wall studs 120. For example, some embodiments of cabinet 140 have a width that permits in-wall dehumidifier 110 to be installed between wall studs 120 that are 16 or 24 inches apart. In some embodiments, cabinet 140 has a depth that permits in-wall dehumidifier 110 to be blindly installed into a wall without having to remove any portion of drywall 130B from the back side of the wall. For example, cabinet 140 may have a depth that allows it to be installed in walls that utilize typical 2×4 or 2×6 wall studs 120 without removing any portion of drywall 130B.

In-wall dehumidifier 110 includes fan 410 that, when activated, draws airflow 101 into in-wall dehumidifier 110 via air diffuser 210. Fan 410 causes airflow 101 to flow through evaporator 320 and into condenser 310, and exhausts airflow 101 out of in-wall dehumidifier 110 via air diffuser 210. In some embodiments, fan 410 is located within cabinet 140 behind evaporator 320 as illustrated in FIG. 4. In such embodiments, fan 410 is installed between evaporator 320 and a back surface of cabinet 140 (i.e., the side of cabinet 140 that is opposite air diffuser 210). Fan 410 may be any type of air mover (e.g., axial fan, forward inclined impeller, backward inclined impeller, etc.) that is configured to generate airflow 101 that flows through in-wall dehumidifier 110 for dehumidification and exits in-wall dehumidifier 110 through air diffuser 210.

In-wall dehumidifier 110 includes various components to provide dehumidification to airflow 101. In-wall dehumidifier 110 may include condenser 310, evaporator 320, and compressor 330. Particular embodiments of condenser 310 are described in more detail below with respect to FIG. 13. These and other internal components of in-wall dehumidifier 110 are uniquely arranged so as to minimize the size of in-wall dehumidifier 110 and allow it to fit between wall studs 120 in a wall, to provide quiet and efficient dehumidification, and to minimize or eliminate unwanted drafts. As discussed above, fan 410 may be located within cabinet 140 behind evaporator 320 as illustrated in FIG. 4. In some embodiments, condenser 310 may be located in a top compartment of in-wall dehumidifier 110, evaporator 320 may be installed in a center compartment of in-wall dehumidifier 110, and compressor 330 may be located in a bottom compartment of in-wall dehumidifier 110 as illustrated in FIG. 3. In other embodiments, any other appropriate arrangement of these and other components of in-wall dehumidifier 110 may be used.

In some embodiments, evaporator 320 is physically isolated from cabinet 140 around the edges/sides of evaporator 320. In other words, evaporator 320 may include gaps on some or all sides of evaporator 320 that allow for bypass air (i.e., air that does not enter evaporator 320) to move between evaporator 320 and cabinet 140. This helps to keep conduction to cabinet 140 to a minimum, thereby reducing or eliminating cold spots on cabinet 140 which may cause condensation.

In some embodiments, dehumidifier 110 includes various unit mounting holes 350 for mounting in-wall dehumidifier 110 to wall studs 120, and air diffuser mounting holes 360 for mounting air diffuser 210 to in-wall dehumidifier 110. In some embodiments, unit mounting holes 350 and air diffuser mounting holes 360 have different shapes as illustrated in FIG. 3 to aid in the installation of in-wall dehumidifier 110. For example, unit mounting holes 350 may have an oblong shape and air diffuser mounting holes 360 may be round in some embodiments. This may help the installer to distinguish the purpose for each of the holes. Furthermore, by having an oblong shape, unit mounting holes 350 may enable the installer to adjust the position of in-wall dehumidifier 110 so that the sides of cabinet 140 are not in contact with wall studs 120. This may help to lower the amount of noise and vibration caused by dehumidifier 110 when it is in operation.

In some embodiments, in-wall dehumidifier 110 may include one or more sensors 370 for sensing temperature, humidity, and other environmental conditions needed for proper operation of in-wall dehumidifier 110. In some embodiments, as illustrated in FIG. 3, sensor 370 may be installed below drain pan 340 and proximate to evaporator 320 so that it may sense airflow 101 before it enters evaporator 320. In this position, sensor 370 is located away from the coils of evaporator 320 in a low, constant bypass airflow, thereby providing for more accurate ambient measurements. In some embodiments, bypass air (i.e., a portion of the airflow that does not enter evaporator 320) is present under drain pan 340 and evaporator 320. The bypass air flows over sensor 370 to give an accurate reading of the conditioned space. This helps to keep drain pan 340 dry and allows for the air volume over condenser 310 to be different greater) than the airflow over evaporator 320 while still only using one fan 410. This improves moisture removal efficiency. Sensor 370 may be any appropriate sensor such as a thermometer, humidistat, pressure sensor, and the like.

FIGS. 5A-5B illustrate perspective views of air diffuser 210, according to certain embodiments. As explained above, air diffuser 210 generally threes output airflow 101 along the surfaces of the wall in which in-wall dehumidifier 110 is installed (i.e., parallel to the wall surfaces). This is in contrast to typical systems which send dehumidified air back into the living space perpendicular to the wall, thereby causing undesirable drafts in the living spaces. In some embodiments, air diffuser 210 includes an outlet 212, an inlet 214, and a divider 216. Airflow 101 may enter in-wall dehumidifier 110 through inlet 214 and may exit in-wall dehumidifier 110 through outlet 212. Divider 216 is generally configured to prevent airflow 101 entering cabinet 140 through inlet 214 from mixing with airflow 101 exiting cabinet 140 from outlet 212. In some embodiments, divider 216 contacts a foam strip (or any other material) located on the front of cabinet 140 between condenser 310 and evaporator 320 in order to further restrict the mixing of airflow 101.

FIGS. 6A-6B illustrate various electrical and plumbing knockouts of in-wall dehumidifier 110, according to certain embodiments. FIG. 6A illustrates various electrical knockouts 610 that may be included in cabinet 140 that permit electrical cables to enter/exit cabinet 140. In some embodiments, one or more electrical knockouts 610 may be included in any appropriate location within cabinet 140 (e.g., the bottom, sides, or back). In some embodiments, multiple electrical knockouts 610 are included to accommodate installations with varying wall depths. FIG. 6B illustrates various drain hose knockouts 620 that may be included in cabinet 140 that permit a drain hose to enter/exit cabinet 140. Similar to electrical knockouts 610, one or more drain hose knockouts 620 may be included in any appropriate location within cabinet 140 (e.g., the bottom, sides, or back).

FIGS. 7A-7B illustrate various views of an optional bezel 710 that may be used with in-wall dehumidifier 110, according to certain embodiments. In some embodiments, in-wall dehumidifier 110 may be sized to be blindly installed within walls that utilize 2×6 wall studs 120 and be flush with the surface of the wall. Such embodiments may also be blindly installed in walls with 2×4 wall studs 120, but will not be flush with the wall. If such embodiments are blindly installed in walls with 2×4 wall studs 120, bezel 710 may be added to enhance the appearance of in-wall dehumidifier 110 and provide for a more professional-looking installation.

FIGS. 8A-8B illustrate various views of fan 410, according to certain embodiments. In some embodiments, fan 410 is located between evaporator 320 and a back panel 145 of cabinet 140 as illustrated in FIG. 8B. In some embodiments, fan 410 includes a blower scroll 810 that is coupled to back panel 145. In some embodiments, blower scroll 810 includes a molded clamp 815 that securely fastens a rigid wiring conduit 820 against back panel 145, as illustrated. Molded clamp 815 and rigid wiring conduit 820 helps protect wires within rigid wiring conduit 820 from being damaged by rotating components of fan 410 (e.g., a squirrel cage) while still maintaining the overall depth of cabinet 140.

FIG. 9 illustrates various brackets of in-wall dehumidifier 110, according to certain embodiments. In some embodiments, a shipping bracket 910 may be included as illustrated in order to secure compressor 330 during shipment. Shipping bracket 910 may be removed during installation of in-wall dehumidifier 110. In some embodiments, in-wall dehumidifier 110 may include a compressor mounting bracket 920 as illustrated. In general, compressor mounting bracket 920 may be installed in place of standard washers used to secure compressor 330 to cabinet 140. Compressor mounting bracket 920 may provide a more secure attachment for compressor 330 during shipping and rough handling of in-wall dehumidifier 110. Furthermore, by being secured at two locations, compressor mounting bracket 920 may be prevented from touching compressor 330, thereby mitigating sound and vibration caused by compressor 330 when in operation.

FIG. 10 illustrates condenser brackets 1010A-B that may be used to attach condenser 310 to in-wall dehumidifier 110, according to certain embodiments. In some embodiments, condenser 310 may be used to hard mount condenser 310 to cabinet 140 in order to conduct heat out of condenser 310 and into cabinet 140 where it may help reduce or eliminate condensation on in-wall dehumidifier 110.

FIG. 11 illustrates an example drain pan 340 of in-wall dehumidifier 110, according to certain embodiments. In general, drain pan 340 collects water that is removed from airflow 101 by in-wall dehumidifier 110. In some embodiments, drain pan 340 includes a drain 347. Any appropriate hose may be coupled to drain 347 in order to direct water out of in-wall dehumidifier 110. In some embodiments, drain pan 340 is sloped as illustrated in order to direct water to drain 347. In some embodiments, drain pan 340 includes a notch 345 and a tab 346 that are configured to direct an overflow from drain pan 340 to a front face of cabinet 140, thereby causing the overflow to be visible when in-wall dehumidifier 110 is installed in the wall. As illustrated, notch 345 may be at a top, front corner of drain pan 340 and may only extend down a certain portion of the height of drain pan 340 in order to direct any overflow to the front of cabinet 140. In some embodiments, tab 346 is directly below notch 345 as illustrated.

FIG. 12 illustrates a fan outlet diffuser 1210 of in-wall dehumidifier 110, according to certain embodiments. In general, fan outlet diffuser 1210 includes a number of apertures that are configured to evenly distribute airflow 101 as it leaves fan 410 and enters condenser 310. This helps to reduce any noise caused by airflow 101. In some embodiments, fan outlet diffuser 1210 is coupled to condenser bracket 1010B as illustrated, which is between the outlet of fan 410 and condenser 310. The apertures of fan outlet diffuser 1210 may have any appropriate shape including, but not limited to, circular, polygonal (e.g., square, hexagonal, etc.), and the like. Any appropriate number and size of apertures may be included in fan outlet diffuser 1210.

FIG. 13 illustrates an embodiment of condenser 310 that includes dual condenser coils 310A-B that may be used by in-wall dehumidifier 110, according to certain embodiments. The arrangement of components in FIG. 13 are for illustrative purposes only. In some embodiments, condenser 310, evaporator 320, and compressor 330 may be arranged as illustrated in FIG. 3 condenser 310 at the top of cabinet 140, evaporator 320 below condenser 310, and compressor 330 below evaporator 320). In some embodiments, second condenser coil 310E is connected to compressor 330 via a superheated vapor line 1310. First condenser coil 310A is connected to evaporator 320 via a subcooled liquid line 1330. In some embodiments, an expansion valve is included on subcooled liquid line 1330 between first condenser coil 310A and evaporator 320. First condenser coil 310A and second condenser coil 310B are connected via a condenser connection line 1320. Condenser connection line 1320 connects an output of second condenser coil 310B with an input of first condenser coil 310A. In other words, condenser coils 310 are connected in series, which provides many advantages as discussed in more detail below.

In some embodiments, condenser coils 310A-B are microchannel condensers that are made of aluminum. In general, microchannel condensers provide numerous features including a high heat transfer coefficient, a low air-side pressure restriction, and a compact design (compared to other solutions such as finned tub exchangers). These and other features make microchannel condensers good options for condensers in air conditioning systems where inlet air temperatures are high and airflow is high with low fan power. However, in a dehumidifier, the primary air side pressure drop occurs in the evaporator, and reducing condenser air restriction does not increase airflow significantly. Also, the air temperature upstream of the condenser is typically relatively low, often being below 60° F. The air temperature leaving the condenser is typically over 100° F. The air temperature across the condenser typically increases over 40° F. Using this low temperature air stream efficiently is the key to a good design. In dehumidifier designs, the refrigeration system typically needs to have at least 20° F. subcooling when a finned tube condenser is used. Since a normal microchannel condenser does not provide cross counter flow, it is very difficult to get 20° F. subcooling. The weakness of micro-channel condenser (e.g., no cross counter flow) becomes significant when air temperature rises over 40° F. across the condenser. Due to this, a typical microchannel condenser is not a good condenser for a dehumidifier. To overcome these and other issues, some embodiments of in-wall dehumidifier 110 include two condenser coils 310A-G connected in series as described herein. In this configuration, the pressure drop of two microchannel condenser coils 310A-B is still lower than that of a single finned tube coil. In addition, since a microchannel coil is thinner than a multi-row finned tube coil, the thickness of two microchannel condenser coils 310A-B is less than an equivalent single finned tube coil. By using two or more microchannel condenser coils 310A-B in series to make a cross counter flow condenser, more than 20° F. of subcooling may be achieved with a reasonable approach temperature when inlet air temperature is below 60° F. Furthermore, aluminum is typically less costly than copper, so the cost of a dual microchannel aluminum condenser is less than a single finned copper tube condenser.

In operation, refrigerant flows from evaporator 320 into compressor 330, from compressor 330 into second condenser coil 310B via superheated vapor line 1310, from second condenser coil 310B into first condenser coil 310A via condenser connection line 1320, from first condenser coil 310A back to evaporator 320 (through an expansion valve in some embodiments) via subcooled liquid line 1330. The unique configuration of condenser 310 allows the refrigerant to be managed based on the direction of airflow 101 and temperature. That is, the coldest air (i.e., airflow 101 when it first hits first condenser coil 310A) subcools the liquid refrigerant within first condenser coil 310A, and the hottest air (i.e., airflow 101 when it first hits second condenser coil 310E after leaving first condenser coil 310A) de-superheats the vapor refrigerant as it passes through second condenser coil 310B.

While a particular embodiment of condenser 310 has been described as having two condenser coils 310A-B, other embodiments may have more than two condenser coils 310. For example, other embodiments of dehumidification system 1300 may have three or four condenser coils 310. In such embodiments, condenser coils 310 are connected in series using multiple condenser connection lines 1320 as described above.

Although a particular implementation of in-wall dehumidifier 110 is illustrated and primarily described, the present disclosure contemplates any suitable implementation of in-wall dehumidifier 110, according to particular needs. Moreover, although various components of in-wall dehumidifier 110 have been depicted as being located at particular positions, the present disclosure contemplates those components being positioned at any suitable location, according to particular needs.

Herein, "or" is inclusive and not exclusive, unless expressly indicated otherwise or indicated otherwise by context. Therefore, herein, "A or B" means "A, B, or both," unless expressly indicated otherwise or indicated otherwise by context. Moreover, "and" is both joint and several, unless expressly indicated otherwise or indicated otherwise by context. Therefore, herein, "A and B" means "A and B, jointly or severally," unless expressly indicated otherwise or indicated otherwise by context.

The scope of this disclosure encompasses all changes, substitutions, variations, alterations, and modifications to the example embodiments described or illustrated herein that a person having ordinary skill in the art would comprehend.

The scope of this disclosure is not limited to the example embodiments described or illustrated herein. Moreover, although this disclosure describes and illustrates respective embodiments herein as including particular components, elements, feature, functions, operations, or steps, any of these embodiments may include any combination or permutation of any of the components, elements, features, functions, operations, or steps described or illustrated anywhere herein that a person having ordinary skill in the art would comprehend. Furthermore, reference in the appended claims to an apparatus or system or a component of an apparatus or system being adapted to, arranged to, capable of, configured to, enabled to, operable to, or operative to perform a particular function encompasses that apparatus, system, component, whether or not it or that particular function is activated, turned on, or unlocked, as long as that apparatus, system, or component is so adapted, arranged, capable, configured, enabled, operable, or operative. Additionally, although this disclosure describes or illustrates particular embodiments as providing particular advantages, particular embodiments may provide none, some, or all of these advantages.

What is claimed is:

1. A dehumidifier, comprising:

a cabinet configured to be installed between studs in a wall;

an air diffuser coupled to the cabinet and comprising an outlet, wherein a portion of the outlet that fluidly couples an interior of the dehumidifier to an exterior of the dehumidifier is parallel to a surface of the wall, wherein the air diffuser is configured to diffuse an airflow to exit through the portion of the outlet along the surface of the wall;

a compressor;

an evaporator installed within the cabinet above the compressor;

a condenser installed within the cabinet above the evaporator; and a drain pan installed within the cabinet below the evaporator, the drain pan comprising a notch and a tab configured to direct an overflow from the drain pan to a front face of the cabinet, thereby causing the overflow to be visible when the dehumidifier is installed in the wall, wherein the notch is disposed at a top of the drain pan, wherein the tab is disposed below the notch, the drain pan further comprising a drain, wherein the drain pan is sloped to direct the water removed from the airflow inward away from the tab and toward the drain and to prevent the overflow from flowing out of the notch.

2. The dehumidifier of claim 1, wherein the condenser comprises a plurality of microchannel condenser coils.

3. The dehumidifier of claim 2, wherein the plurality of microchannel condenser coils comprises:

a first microchannel condenser coil located so as to receive the airflow after it has passed through the evaporator; and a second microchannel condenser coil located proximate to the first microchannel condenser coil, the second microchannel condenser coil located on a side of the microchannel condenser coil so as to receive the airflow after it has passed through the first microchannel condenser coil.

4. The dehumidifier of claim 3, wherein an input of the first microchannel condenser coil receives a refrigerant flow from an output of the second microchannel condenser coil.

5. The dehumidifier of claim 1, further comprising a plurality of thermally-conductive brackets configured to secure the condenser to the cabinet.

6. The dehumidifier of claim 1, further comprising:

a sensor installed below the drain pan, the sensor configured to sense one or more environmental conditions of a bypass portion of the airflow.

7. The dehumidifier of claim 1, wherein:

the air diffuser further comprises a divider configured to prevent the airflow entering the cabinet through an inlet of the air diffuser from mixing with the airflow exiting the cabinet from an outlet of the air diffuser; and the outlet of the air diffuser is above the inlet of the air diffuser.

8. The dehumidifier of claim 1, wherein the cabinet is further configured to be installed with access from only one side of the wall.

9. The dehumidifier of claim 1, further comprising:

a fan installed between the evaporator and a back surface of the cabinet, the fan configured to generate the airflow that flows into the cabinet through an inlet of the air diffuser and out of the cabinet through an outlet of the air diffuser, the airflow flowing through the evaporator and condenser in order to provide dehumidification to the airflow; and a fan outlet diffuser installed above the fan, the fan outlet diffuser comprising a plurality of apertures configured to evenly distribute the airflow to the condenser from the fan, thereby reducing noise caused by the airflow.

10. A dehumidifier, comprising:

a cabinet configured to be installed between studs in a wall;

an air diffuser coupled to the cabinet and comprising an inlet, a first outlet above the inlet, a second outlet and a third outlet, the second and third outlets configured to diffuse an airflow from the dehumidifier in opposite directions from each other, the first outlet configured to diffuse an airflow from the dehumidifier in a direction that is the same as airflow received through the inlet and perpendicular to the airflow diffused by the second outlet and the third outlet, wherein each one of the first outlet, the second outlet, and the third outlet fluidly couples an interior of the dehumidifier to an exterior of the dehumidifier and is parallel to a surface of the wall, wherein the air diffuser is configured to diffuse an airflow to exit along the surface of the wall;

a compressor;

an evaporator installed within the cabinet above the compressor;

a condenser installed within the cabinet above the evaporator;

a drain pan installed within the cabinet below the evaporator, the drain pan comprising a notch and a tab configured to direct an overflow from the drain pan to a front face of the cabinet, thereby causing the overflow to be visible when the dehumidifier is installed in the wall, wherein the notch is disposed at a top of the drain pan, wherein the tab is disposed below the notch, the drain pan further comprising a drain, wherein the drain pan is sloped to direct the water removed from the airflow inward away from the tab and toward the drain and to prevent the overflow from flowing out of the notch; and a fan installed between the evaporator and a back surface of the cabinet, the fan configured to generate the airflow that flows into the cabinet through the evaporator and out of the cabinet through condenser, the airflow flowing through the evaporator and condenser in order to provide dehumidification to the airflow.

11. The dehumidifier of claim 10, wherein the condenser comprises a plurality of microchannel condenser coils.

12. The dehumidifier of claim 11, wherein the plurality of microchannel condenser coils comprises:

a first microchannel condenser coil located so as to receive the airflow after it has passed through the evaporator; and a second microchannel condenser coil located proximate to the first microchannel condenser coil, the second microchannel condenser coil located on a side of the microchannel condenser coil so as to receive the airflow after it has passed through the first microchannel condenser coil.

13. The dehumidifier of claim 12, wherein an input of the first microchannel condenser coil receives a refrigerant flow from an output of the second microchannel condenser coil.

14. The dehumidifier of claim 10, further comprising:

a sensor installed below the drain pan, the sensor configured to sense one or more environmental conditions of a bypass portion of the airflow.

15. The dehumidifier of claim 10, further comprising a fan outlet diffuser installed above the fan, the fan outlet diffuser comprising a plurality of apertures configured to evenly distribute the airflow to the condenser from the fan, thereby reducing noise caused by the airflow.

16. A dehumidifier, comprising:

a cabinet configured to be installed between studs in a wall;

an air diffuser coupled to the cabinet and comprising an inlet, an outlet above the inlet, and a divider between the inlet and outlet, the divider configured to prevent the airflow entering the cabinet through the inlet from mixing with the airflow exiting the cabinet from the outlet, wherein a portion of the outlet that fluidly couples an interior of the dehumidifier to an exterior of the dehumidifier is parallel to a surface of the wall, wherein the air diffuser is configured to diffuse an airflow to exit through the portion of the outlet along the surface of the wall;

a compressor;

an evaporator installed within the cabinet above the compressor;

a condenser installed within the cabinet above the evaporator, the condenser comprising a plurality of microchannel condenser coils;

a fan installed between the evaporator and a back surface of the cabinet, the fan configured to generate the airflow that flows into the cabinet through the inlet of the air diffuser and out of the cabinet through the outlet of the air diffuser, the airflow flowing through the evaporator and condenser in order to provide dehumidification to the airflow;

a drain pan installed within the cabinet below the evaporator, the drain pan configured to capture water removed from the airflow by the evaporator, the drain pan comprising a notch and a tab configured to direct an overflow from the drain pan to a front face of the cabinet, thereby causing the overflow to be visible when the dehumidifier is installed in the wall, wherein the notch is disposed at a top of the drain pan, wherein the tab is disposed below the notch, the drain pan further comprising a drain, wherein the drain pan is sloped to direct the water removed from the airflow inward away from the tab toward the drain and to prevent the overflow from flowing out of the notch; and a sensor installed below the drain pan, the sensor configured to sense one or more environmental conditions of a bypass portion of the airflow.

17. The dehumidifier of claim 16, further comprising a plurality of thermally conductive brackets configured to secure the condenser to the cabinet.

18. The dehumidifier of claim 16, further comprising a fan outlet diffuser installed above the fan, the fan outlet diffuser comprising a plurality of apertures configured to evenly distribute the airflow to the condenser from the fan, thereby reducing noise caused by the airflow.

19. The dehumidifier of claim 16, wherein the plurality of microchannel condenser coils comprises:

a first microchannel condenser coil located so as to receive the airflow after it has passed through the evaporator; and a second microchannel condenser coil located proximate to the first microchannel condenser coil, the second microchannel condenser coil located on a side of the microchannel condenser coil so as to receive the airflow after it has passed through the first microchannel condenser coil.

20. The dehumidifier of claim 19, wherein an input of the first microchannel condenser coil receives a refrigerant flow from an output of the second microchannel condenser coil.

* * * * *